US007985335B2

(12) United States Patent
Allard

(10) Patent No.: US 7,985,335 B2
(45) Date of Patent: Jul. 26, 2011

(54) LOW PROFILE CATCH BASIN FILTER

(75) Inventor: Douglas Allard, Occidental, CA (US)

(73) Assignee: Kristar Enterprises, Inc., Santa Rosa, CA (US)

( * ) Notice: Subject to any disclaimer, the term of this patent is extended or adjusted under 35 U.S.C. 154(b) by 0 days.

(21) Appl. No.: 12/382,135

(22) Filed: Mar. 9, 2009

(65) Prior Publication Data

US 2009/0250405 A1 Oct. 8, 2009

Related U.S. Application Data

(60) Provisional application No. 61/064,491, filed on Mar. 7, 2008.

(51) Int. Cl.
*E03F 5/14* (2006.01)

(52) U.S. Cl. ..... 210/155; 210/164; 210/170.03; 210/254; 210/266; 404/4

(58) Field of Classification Search ..... 210/691, 210/747, 806, 155, 162, 163, 164, 170.03, 210/254, 266, 335, 474; 404/4, 5
See application file for complete search history.

(56) References Cited

U.S. PATENT DOCUMENTS

| | | | | |
|---|---|---|---|---|
| 6,200,484 | B1 * | 3/2001 | McInnis | 210/170.03 |
| 6,270,663 | B1 * | 8/2001 | Happel | 210/163 |
| 6,287,459 | B1 * | 9/2001 | Williamson | 210/164 |
| 6,533,941 | B2 * | 3/2003 | Butler | 210/170.03 |
| 6,551,505 | B2 * | 4/2003 | Chinn et al. | 210/164 |
| 6,709,579 | B1 * | 3/2004 | Singleton et al. | 210/163 |
| 7,112,274 | B1 * | 9/2006 | Sanguinetti | 210/163 |
| 7,357,861 | B2 * | 4/2008 | Kelley et al. | 210/162 |
| 2004/0232057 | A1 * | 11/2004 | Orozco et al. | 210/155 |
| 2006/0169648 | A1 * | 8/2006 | Fitzgerald | 210/747 |
| 2008/0073277 | A1 * | 3/2008 | Paoluccio et al. | 210/691 |

* cited by examiner

*Primary Examiner* — Christopher Upton

(57) ABSTRACT

A catch basin configured to filter water by way of a matrix filter and a filter pouch. If the matrix filter should become clogged, a bypass weir provides means of bypassing the matrix filter to prevent the catch basin from clogging.

11 Claims, 3 Drawing Sheets

LOW PROFILE CATCH BASIN FILTER

This application claims benefit of U.S. Provisional Application No. 61/064,491 filed Mar. 7, 2008 and entitled, "Trench Drain Filter." The foregoing application is hereby incorporated herein by reference.

FIELD OF THE INVENTION

A filter for use in a catch basin or trench drain. The filter provides two paths for water to flow through the basin to an outlet. The first path is through a matrix filter and then through a filtering pouch to an outlet. The second path bypasses the matrix filter. A bypass weir helps guide water away from the matrix filter when the matrix filter is clogged.

BACKGROUND OF THE INVENTION

Runoff and drainage from streets, highways, parking lots, and other similar areas is of increasing concern. Often sediment, leaked fluids, rubber, metal particles, dirt, and other debris are washed off of an area by surface water and carried into existing drainage systems or the environment. The tainted water may be carried along existing drainage systems to treatment facilities already strained to capacity or may be expelled directly into natural bodies of water.

In the past, catch basins have been used to capture runoff and waste water from roadways, parking lots, and other areas. These drains often consist of grate-covered basins which collect the runoff and waste water. Runoff and waste water are then channeled into a local drainage system or into a more convenient location or facility which may appropriately deal with the waste water and runoff.

There is a long recognized need to perform some measure of primary treatment of wastewaters. By initially treating the wastewaters and runoff, people may not only help lessen the strain on existing treatment facilities, but may also prevent certain undesirable chemicals and waste from reaching the environment and may aid in the operation of existing water channeling and treatment infrastructure by limiting the amount of debris and waste that enter the infrastructure and either clog or otherwise cause damage to it.

In the past, filters have been added to traditional catch basins. These filters provide a basic filtering capability and generally filter larger debris and other contaminants from waste water and runoff. These filters, however, have several limitations. The first being that the catch basin must be large enough to contain the filtering apparatus. Often catch basins have been built small and/or shallow, either because of the physical requirements of the area being drained or because the trench was dug without consideration of the addition of filtering capacity. In such cases, a conventional catch basin filter is not only inconvenient but impossible for use.

What is needed, then, is an apparatus, method, and system of filtering waste water and runoff without the need for deep or large basins. Moreover, what is needed is an apparatus, method, and system of filtering that removes not only physical debris, but also hydrocarbons from the waste water and runoff.

SUMMARY OF THE INVENTION

A filter for use in a catch basin or trench drain. The filter provides two paths for water to flow through the drain to an outlet. The first path is through a matrix filter and then through a filtering pouch to an outlet. The second path bypasses the matrix filter. A bypass weir helps guide water away from the matrix filter when the matrix filter is clogged.

In one embodiment, a catch basin according to the present invention may include an inlet, an outlet, a filter, an inlet flume configured to direct water towards the filter, a bypass weir substantially surrounding the filter, and a filter pouch. The catch basin may include a first flow route comprising the filter body, filtering pouch and the outlet. A second flow route may comprise the outlet. The bypass weir may direct water towards the second flow route if the filter becomes clogged.

These and other objects and advantages of the invention will be apparent from the following description, the accompanying drawings and the appended claims.

BRIEF DESCRIPTION OF THE DRAWINGS

While the specification concludes with claims particularly pointing out and distinctly claiming the present invention, it is believed the same will be better understood from the following description taken in conjunction with the accompanying drawings, which illustrate, in a non-limiting fashion, the best mode presently contemplated for carrying out the present invention, and in which like reference numerals designate like parts throughout the Figures, wherein:

DETAILED DESCRIPTION OF THE INVENTION

The present disclosure will now be described more fully with reference to the Figures in which various embodiments of the present invention are shown. The subject matter of this disclosure may, however, be embodied in many different forms and should not be construed as being limited to the embodiments set forth herein.

Figure 1:
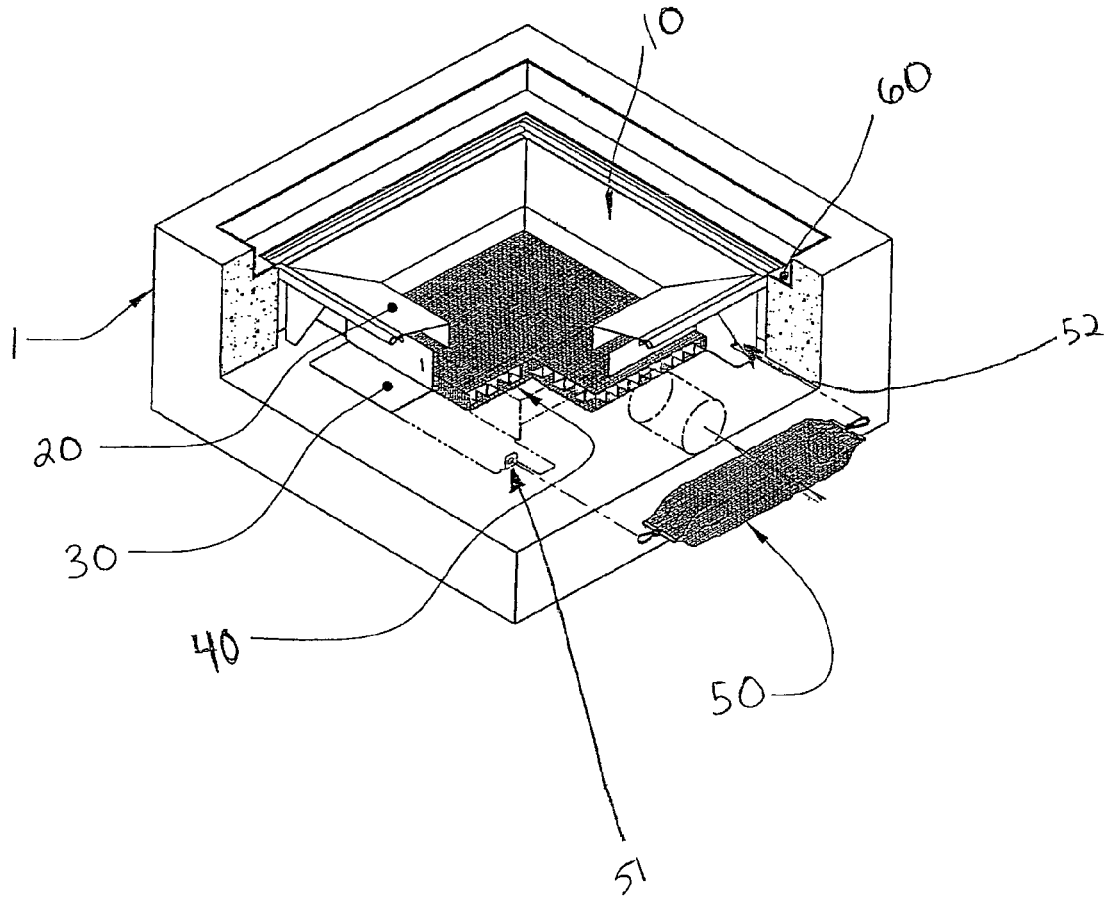
FIG. 1 shows an angled-view of an embodiment of the present invention.

FIG. 1 shows an angled-view of an embodiment of the present invention. Shallow concrete catch basin 1 is well-known in the art. Catch basin 1 contains an interior cavity 10 as well as a lip 60. Catch basin 1 may be any size/shape conducive to run-off and wastewater collection. In some embodiments of the invention, the catch basin 1 has length and width dimensions of 18 inches square; 24 inches square; 36 inches square; 48 inches square; 24 inches by 36 inches; or 36 inches by 48 inches. In at least one embodiment, interior cavity 10 has a minimum depth of 6.5 inches. This allows inlet flume 20, bypass weir frame 30, matrix filter 40, and filter pouch 50 to fit into catch basin 1's interior cavity 10 while a grate (not pictured) rests on lip 60.

Inlet flume 20 directs water flowing through a grate (not pictured) towards matrix filter 40. While inlet flume 20 is preferably made of stainless steel, preferably type 304 or 18/8 stainless steel, it should be noted that inlet flume 20 may be constructed of any suitable material. In some embodiments, inlet flume 20 also includes a rubber gasket 21. Rubber gasket 21 may seal the space between inlet flume 20 and lip 60 and helps ensure that water flows toward the matrix filter 40 (see FIG. 3).

Bypass weir frame 30 may sit along the bottom of interior cavity 10. Although bypass weir frame 30 is preferably made out of type 304 or 18/8 stainless steel as well, it should be noted that bypass weir frame 30 may be made of any suitable material. Bypass weir frame 30 may be positioned along the bottom of the interior cavity 10. By virtue of its position, location, and construction bypass weir frame 30 may serve multiple purposes, one of which may be to help secure and position matrix filter 40.

Figure 2:
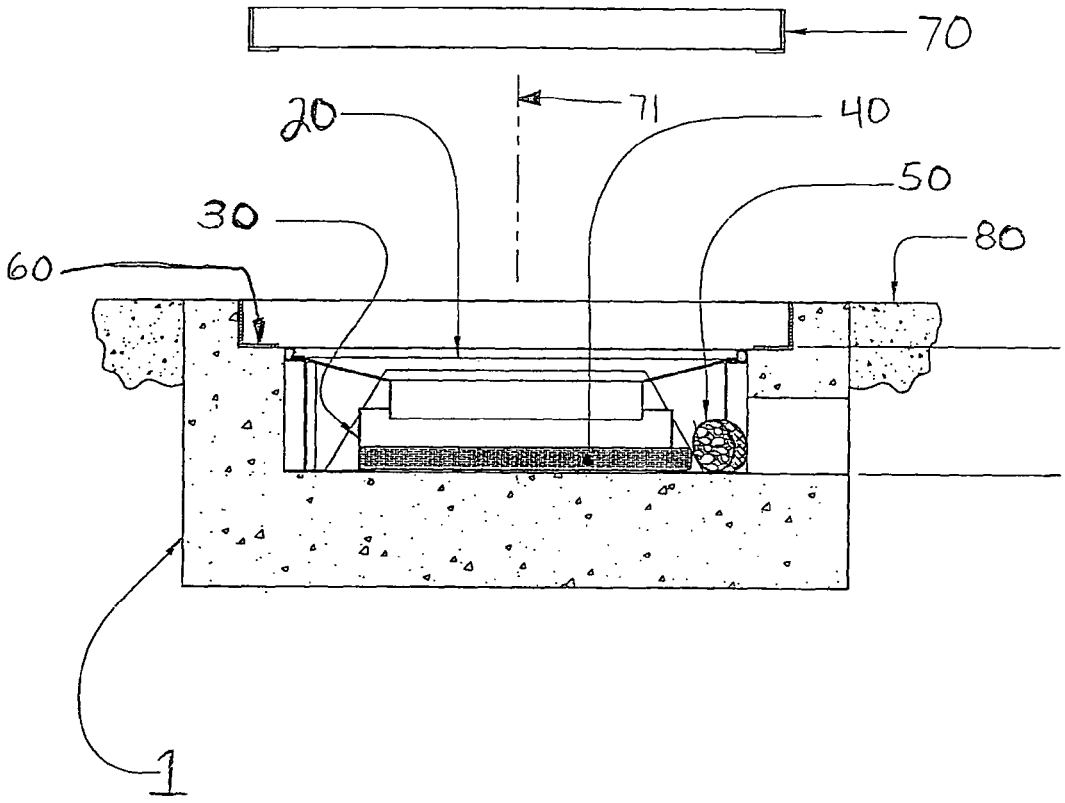
FIG. 2 shows a side-view of an embodiment of the present invention.

FIG. 2 shows a side-view of an embodiment of the present invention. Grate 70 is a drain grate as well known in the art. Grate 70 may be made of any suitable material, such as cast iron, aluminum, bronze, or hard plastic. While cast iron, aluminum, bronze, and plastic are specifically mentioned, it should be noted that grate 70 is not limited to these materials. As can be seen in the figure, grate 70 is positioned on top of lip 60 (as indicated by dashed line 71). Grate 70 and lip 60 are constructed and arranged such that the top of grate 70 forms the top of the catch basin. Moreover, shallow concrete basin 1 is situated with regards to foundation 80 so that, when placed within the lip 60, the top of grate 70 is substantially flush with the surrounding ground level.

As can be seen in FIG. 2, inlet flume 20 sits within concrete basin 1. As water flows over grate 70 and into the present invention, inlet flume 20 helps collect and direct that water towards the matrix filter 40 for filtering.

Filter pouch 50 preferably contains an absorbent material capable of filtering hydrocarbons, such as oil and greases, from fluid. Filter pouch 50 preferably contains absorbent material capable of absorbing hydrocarbons such as fossil rock, although it should be noted that filter pouch 50 may contain any suitable material. As filter pouch contains absorbent material for the retention and collection of oils and greases, said pouch is preferably configured within the concrete basin 1 so that it is easily replaceable. In some embodiments, filter pouch 50 is configured to clip into the concrete basin via attachment tabs 51 and 52 (see FIG. 1). Attachment tabs 51 and 52 allow filter pouch 50 to be securely, yet removably attached so that the filter pouch 50 is easily replaced.

Matrix filter 40 may be constructed of a woven textile surrounding a rigid skeleton. In some embodiments, said woven textile may be a durable polypropylene monofilament geotextile. However, it should be noted that any suitable textile may be used with the present invention. In some embodiments, said rigid skeleton may be formed of polypropylene, however, it should also be noted that any suitably rigid material may be used. The matrix filter may be designed to maximize filtering capabilities while minimizing the physical height or dimension of the matrix filter. Moreover, the matrix filter may be designed to limit the retention of water within the matrix filter.

Along the floor of concrete basin 1 sits bypass weir 30. Bypass weir 30 is positioned substantially below inlet flume 20 and substantially surrounding matrix filter 40. Bypass weir 30 and inlet flume 20 are situated so that there is a gap between the overhang of inlet flume 20 and the upper edge of bypass weir 30. As water flows into the present invention, it enters concrete basin 1 by flowing through grate 70. The water is then directed by inlet flume 20 down towards matrix filter 40. Bypass weir 30 helps guide water flow to the matrix filter 40. If matrix filter 40 should clog or otherwise become impenetrable, gaps between the overhang of inlet flume 20 and the upper edge of bypass weir 30 allow the water to overflow around matrix filter 40 and continue flowing out of outlet 90 (see FIG. 3).

Figure 3:
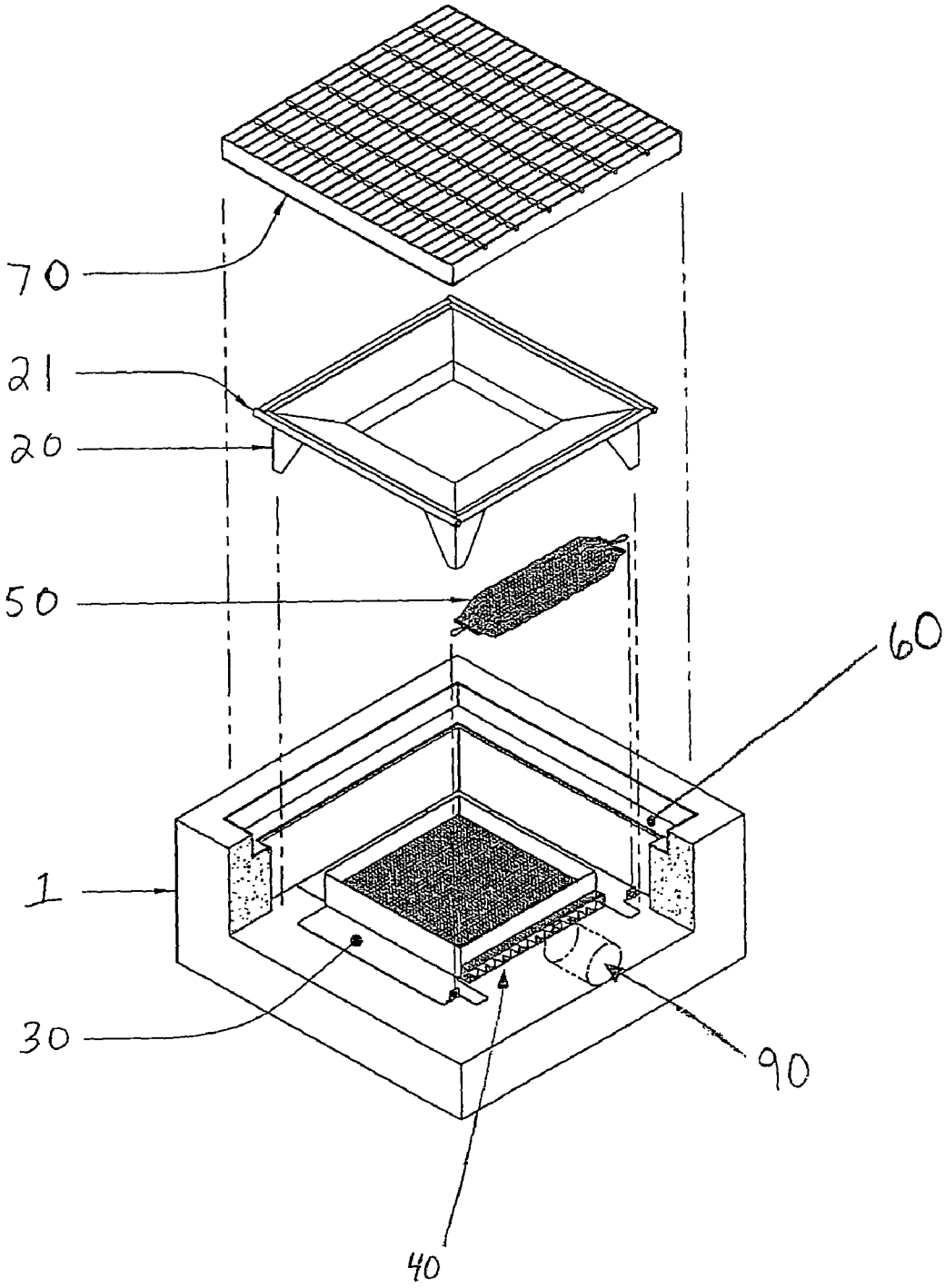
FIG. 3 shows a disassembled-view of an embodiment of the present invention.

FIG. 3 shows a disassembled-view of an embodiment of the present invention. In this figure, dashed lines indicate each part's position and configuration when the present invention is fully assembled. In this figure, inlet flume 20 is shown with rubber gasket 21. Rubber gasket 21 seals the space between inlet flume 20 and lip 60 to help direct water flow through inlet flume 20 toward matrix filter 40. Gasket 21 may be formed of any suitable material such as rubber or silicone.

Bypass weir 30 may be located along the bottom of concrete basin 1. Matrix filter 40 may be located within bypass weir 30. Filter pouch 50 is positioned such that water flows through filter pouch 50 as it is carried towards outlet 90. Inlet flume 20 with gasket 21 may be located above bypass weir 30 and matrix filter 40. Grate 70 may sit above inlet flume 20 on lip 60. As water is flows through grate 70, it is directed by inlet flume 20 towards matrix filter 40. Matrix filter 40 may then filter the water. After an initial filtering by matrix filter 40, water is directed towards outlet 90 through filter pouch 50. Filter pouch 50 may then additionally filter the water before it flows out of outlet 90. As can be seen in the figures, filter pouch 50, when in an elongated embodiment, may be positioned such that the pouch's longer sides sit substantially perpendicular to the outlet. Moreover, there may be a gap between the upper edge of the filtering pouch and the outlet to allow water to flow over the pouch if necessary.

If matrix filter 40 were to become clogged or otherwise inoperable and incapable of allowing water and fluid to flow through it, bypass weir 30, in conjunction with inlet flume 20 would allow the water to flow around the matrix filter 40 and into the outlet 90. In some embodiments, water flowing in such an overflow scenario may bypass filter pouch 50. In other embodiments, water would be directed to filter pouch 50 even if matrix filter 40 has become clogged. Bypass weir 30 and inlet flume 20 work to provide a bypass for water in such a scenario by virtue of gaps and spacing provided between the two items allowing rising water to flow over the sidewalls of the bypass weir 30 and under the overhang of inlet flume 20 (see FIG. 2), and then around matrix filter 40.

The foregoing description of specific embodiments of the present invention are presented for purposes of illustration and description. They are not intended to be exhaustive or to limit the invention to the precise forms disclosed. Obviously, many modifications and variations are possible in view of the above teachings. While the embodiments were chosen and described in order to best explain the principles of the invention and its practical applications, thereby enabling others skilled in the art to best utilize the invention, various embodiments with various modifications as are suited to the particular use are also possible. The scope of the invention is to be defined only by the claims appended hereto, and by their equivalents.

What is claimed is:

1. A catch basin filter, comprising:

(a) a filter, wherein said filter comprises a textile surrounding a rigid skeleton;

(b) an inlet flume positioned upstream of said filter and configured to direct fluid towards said filter;

(c) a pouch positioned downstream of said filter;

(d) an outlet positioned downstream of said pouch; and (e) a bypass weir positioned downstream of said inlet flume, said bypass weir substantially surrounding said filter and positioned along the bottom of the basin wall and configured to direct fluid passing through said weir to said outlet.

2. The catch basin filter of claim 1, wherein said textile is polypropylene monofilament geotextile fabric.

3. The catch basin filter of claim 1, wherein said rigid skeleton is formed of polypropylene.

4. The catch basin filter of claim 1, wherein said pouch includes an absorbent material capable of collecting and retaining hydrocarbons.

5. The catch basin filter of claim 4, wherein said pouch includes fossil rock.

6. A catch basin filter wherein said filter comprising:

a) a first flow route comprising:

i) a filter, wherein said filter comprises a textile surrounding a rigid skeleton;

ii) an inlet flume positioned upstream of said filter and configured to direct fluid towards said filter;

iii) a pouch positioned downstream of said filter; and iv) an outlet positioned downstream of said pouch; and b) a second flow path comprising:

i) an inlet flume; and ii) a bypass weir positioned downstream of said inlet flume, said bypass weir substantially surrounding said filter and positioned along the bottom of the catch basin wall and configured to direct fluid passing through said weir to said outlet.

7. The catch basin filter of claim 6, wherein said filter comprises a textile surrounding a rigid skeleton.

8. The catch basin filter of claim 7, wherein said textile is polypropylene monofilament geotextile fabric.

9. The catch basin filter of claim 7, wherein said rigid skeleton is formed of polypropylene.

10. The catch basin filter of claim 6, wherein said pouch comprises an absorbent material capable of collecting and retaining hydrocarbons.

11. The catch basin filter of claim 6, wherein said pouch includes fossil rock.

* * * * *